US008707845B2

(12) United States Patent
Koch et al.

(10) Patent No.: US 8,707,845 B2
(45) **Date of Patent: *Apr. 29, 2014**

(54) CASE ACTIVATION BULLET FEEDER

(75) Inventors: Steven J. Koch, Oroville, CA (US); Ronald L. Smith, Oroville, CA (US)

(73) Assignee: Alliant Techsystems Inc., Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/406,200

(22) Filed: Feb. 27, 2012

(65) Prior Publication Data

US 2012/0210850 A1 Aug. 23, 2012

Related U.S. Application Data

(63) Continuation of application No. 12/435,138, filed on May 4, 2009, now Pat. No. 8,122,808.

(51) Int. Cl.
*F42B 33/00* (2006.01)
*F42B 5/067* (2006.01)

(52) U.S. Cl.
USPC ..... 86/43; 86/23; 86/45

(58) Field of Classification Search
USPC ..... 86/19.5, 23, 24, 43, 45, 46
See application file for complete search history.

(56) References Cited

U.S. PATENT DOCUMENTS

| | | | |
|---|---|---|---|
| 2,970,508 | A | 2/1961 | Wicks |
| 3,282,147 | A | 11/1966 | Havourd et al. |
| 3,343,444 | A | 9/1967 | Lee |
| 3,602,084 | A | 8/1971 | Corcoran |
| 4,005,630 | A | 2/1977 | Patrick |
| 4,088,332 | A | 5/1978 | Chase |
| 4,133,249 | A | 1/1979 | Bachhuber et al. |
| 4,429,610 | A | 2/1984 | Mantel |
| 4,475,435 | A | 10/1984 | Mantel |
| 4,573,392 | A | 3/1986 | Mantel |
| 4,677,894 | A | 7/1987 | Pongratz et al. |
| 4,887,508 | A | 12/1989 | Bianco |
| 5,179,243 | A | 1/1993 | Schroeder |
| 5,932,828 | A | 8/1999 | Hornady et al. |
| 6,041,687 | A | 3/2000 | Fowler |
| 6,209,460 | B1 | 4/2001 | Isle et al. |
| 6,412,385 | B1 | 7/2002 | Willis |
| 6,481,916 | B1 | 11/2002 | Hornady et al. |

(Continued)

OTHER PUBLICATIONS

Application and File History of U.S. Appl. No. 12/435,138, Inventor Steven J. Koch et al., filed May 4, 2009, now U.S. Patent No. 8,122,808 issued Feb. 28, 2012.

*Primary Examiner* — Bret Hayes
(74) *Attorney, Agent, or Firm* — Christensen Fonder P.A.

(57) ABSTRACT

A bullet feeding device has an expandable collet insertable into a die body. The die body receives bullets from a source and directs the bullets to the expandable collet. The expandable collet restricts the passage of the bullet through the die body until the mouth of a cartridge case is inserted into the die body opposite the bullet. The mouth of the cartridge case causes the expandable collet to expand and allow the single bullet to pass through the expandable collet and be placed in the mouth of the cartridge case. As the completed cartridge is drawn from the die body, the expandable collet and prevents the passage of additional bullets until a new cartridge case is inserted. The bullet feeding device may accept bullets of different lengths and shapes. The collet is interchangeable with expandable collets of other sizes to be compatible with bullets of different sizes.

15 Claims, 4 Drawing Sheets

(56) References Cited

U.S. PATENT DOCUMENTS

| | | | | |
|---|---|---|---|---|
| 6,772,668 | B2 | 8/2004 | Shields | |
| 7,703,369 | B1 | 4/2010 | Lee | |
| 8,122,808 | B2 * | 2/2012 | Koch et al. | 86/43 |
| 2008/0053296 | A1 | 3/2008 | Koskela | |
| 2008/0053297 | A1 | 3/2008 | Koskela | |
| 2011/0083546 | A1 * | 4/2011 | Palkowitsh | 86/24 |

* cited by examiner

FIG. 1
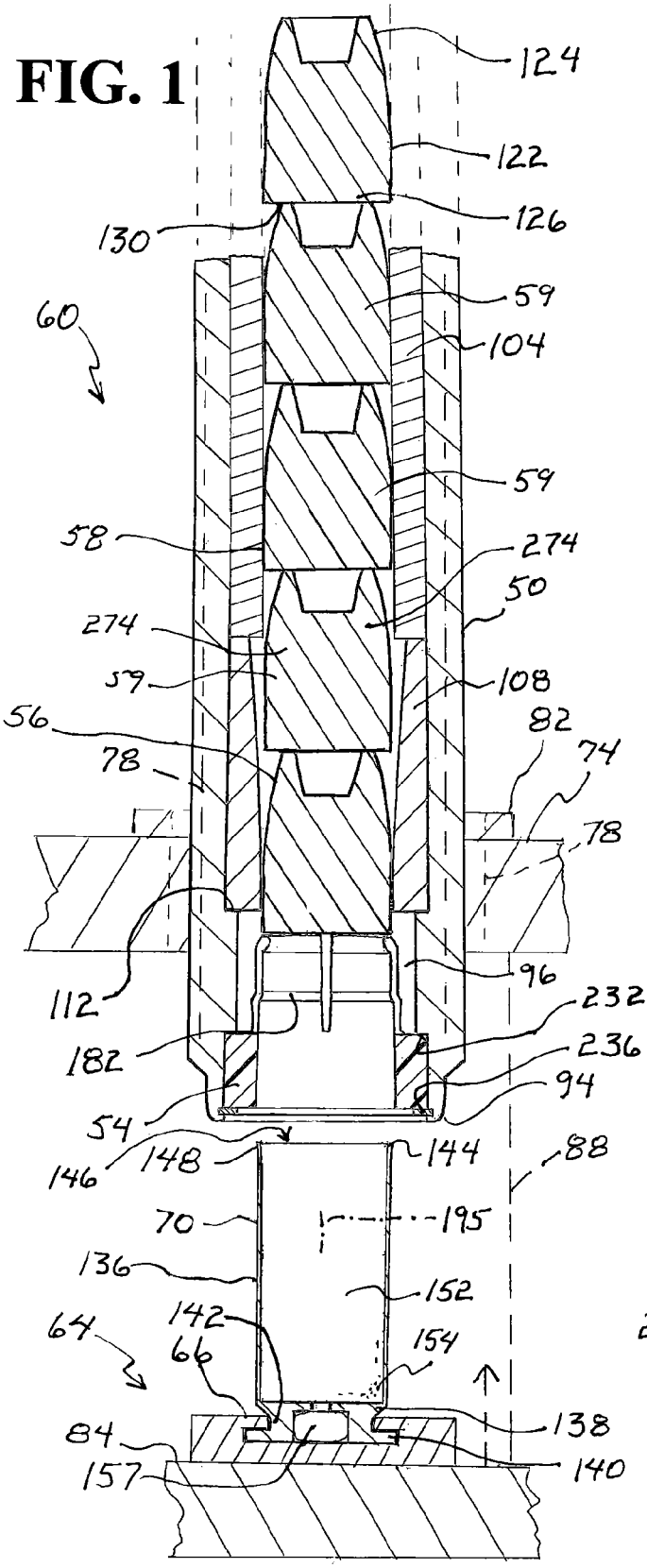
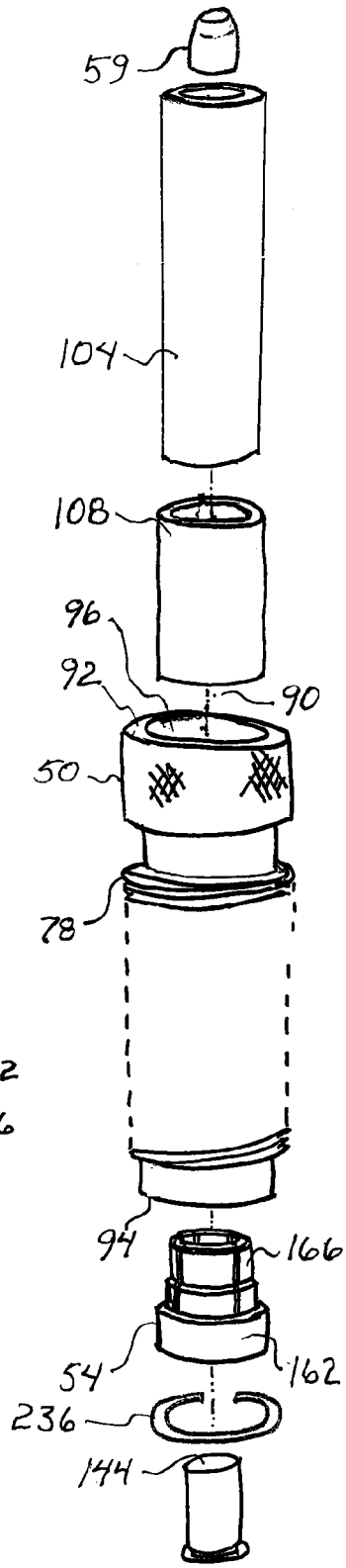
FIG. 2

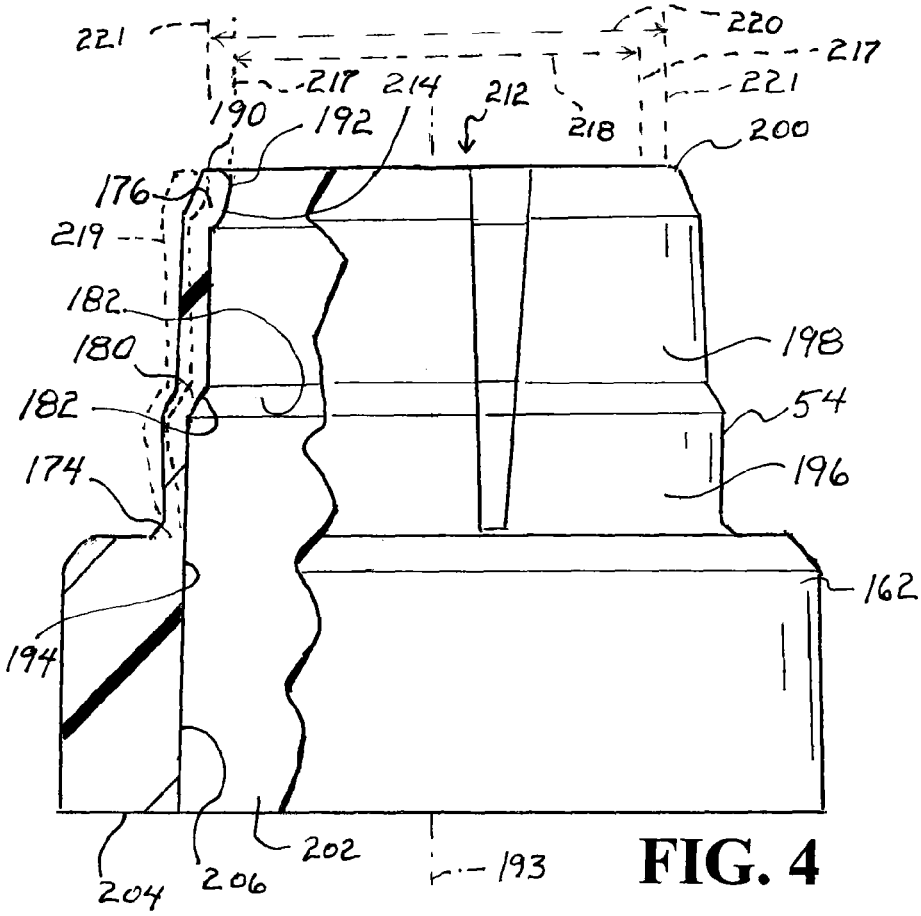
FIG. 4
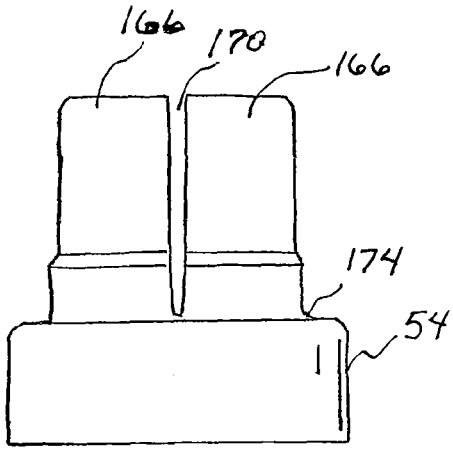
FIG. 3
FIG. 10
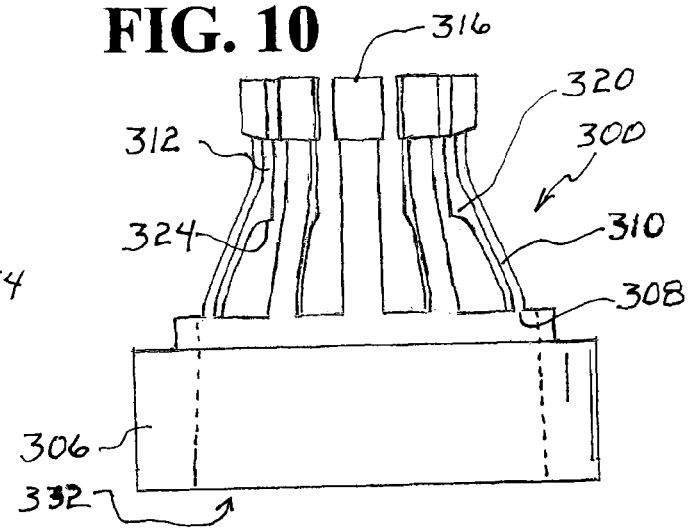

CASE ACTIVATION BULLET FEEDER

PRIORITY CLAIM

This application is a continuation of U.S. patent application Ser. No. 12/435,138, filed May 4, 2009, issuing Feb. 28, 2012 as U.S. Pat. No. 8,122,808 and entitled "CASE ACTIVATION BULLET FEEDING", which application is herein incorporated by reference in its entirety.

FIELD OF THE INVENTION

The present invention is directed to apparatuses and methods for loading or reloading ammunition. Specifically, the present invention is directed to an apparatus and methods for placing bullets within cartridge cases.

BACKGROUND OF THE INVENTION

With small arms such as pistols or rifles, the ammunition or cartridge comprises a gun powder propellant packed into a cartridge case having a primer with a bullet projectile packed in the mouth of the cartridge case. When fired, a firing pin strikes the primer in the cartridge case igniting the gun powder and propelling the bullet from the firearm. The firing pin typically only dents the primer which is replaceable, and thus, spent cartridge cases may be reloaded and reused multiple times.

Such reloading can be done by individuals very economically and further provides the options of customized propellants and/or bullets. Moreover, reloading provides an incentive for the collecting and recycling of spent cartridge cases.

Although reloading has numerous benefits, the reloading process requires substantial skill, specialized equipment, and great care. Errors in the reloading process can be very hazardous causing injuries to the users of the reloaded ammunition as well as bystanders. Generally, spent cartridge cases must be first cleaned and inspected, adjusted back to proper size, primed, and filled with the proper amount of the propellant. Next, a bullet is placed in the mouth of the cartridge case and properly seated sealing the propellant within the cartridge case.

A critical step is the proper placing of the bullet within the mouth of the cartridge case. If the bullet is improperly placed, the bullet may separate from the cartridge case before the bullet is pressed and fully seated. Similarly, if the bullet is incorrectly orientated during pressing, the bullet may malfunction when fired.

Often, during reloading, reloaders will individually insert by hand the bullets into the cartridge cases. This is time consuming and tedious.

Specialized equipment has been used for placing bullets in the cartridge cases. See for example U.S. Pat. Nos. 3,602,084; 4,573,392; and 5,179,243. These devices typically involve numerous moving parts and are mechanically complex. Changing out such bullet feeding components for reloading a different size of ammunition can thus be complicated and difficult. A simple, reliable, bullet feeding system that can be easily changed out for other sizes would be highly desirable.

SUMMARY OF THE INVENTION

The present invention provides an apparatus, components, systems and methods for feeding bullets to and into the mouth of a cartridge case. In a particular embodiment, a press system with a head for holding a housing or die, and a cartridge case holder with a cartridge case are vertically movable together for performing operations during loading or reloading. A collet with finger portions is secured in the housing or die and retains an upright stack of bullets. The collet radially expands by engagement of the cartridge case as the cartridge case holder and head are moved together selectively allowing the bottommost bullet to be placed in the mouth of the cartridge case. Radial contraction of the collet upon withdrawal of the base with the cartridge case and placed bullet retains the balance of the stack of bullets above the collet. In particular embodiments, stack retaining portions of the finger portions follow the curvature of the ogive as the cartridge casing and placed bullet are withdrawn to position the stack retaining portions in a supporting and blocking position underneath a next in line bullet in the upright stack.

In certain embodiments of the invention, a bullet feeding device having a collet insertable into a die body, the collet having radially expandable upwardly extending fingers that are integral with a collar portion. The die body is capable of receiving bullets in the form of a stack with the bottom side of the bullet on the bottom of the stack resting on ends of the fingers. The expandable collet, by way of the finger portion ends, defines an opening sized for restricting the passage of the bullet through the die body until the mouth of a cartridge case is inserted into the die body opposite the bullet. The mouth of the cartridge case engages tapered or stepped surfaces on the movable finger portions to affect a radial expansion of the collet at the finger portion ends. The expansion enlarges the opening to a diameter slightly larger than the maximum diameter of the bullet base allowing the stack of bullets, or a single bullet, to drop through the collet opening at the ends of the collet finger portion ends and for the base of the bottommost bullet to enter into the mouth of the case. In a preferred embodiment the stack of bullets drops a distance to the cartridge case less than the length of the bullets in the stack. As the cartridge case with the bottommost bullet is lowered from the die body, the mouth of the cartridge case disengages the tapered surfaces and the expandable collet contracts around the tip of the bullet and prevents the passage of additional bullets until a new cartridge case is inserted. In certain embodiments, the distal ends of the finger portions engage primarily or only the bottom surface of the bullets. In other embodiments the finger portions my engage the ogive portion of the bullet providing a cam action to urge the bottommost bullet downwardly.

A feature and advantage of certain embodiments is that the expandable collet is capable of accepting bullets of different lengths and shapes. In addition, the expandable collet is easily interchangeable with expandable collets of other sizes for other sizes of bullets and cartridge cases.

A feature and advantage of certain embodiments is that the cartridge case engagement surfaces on the finger portions of the collet are positioned intermediate the connection point of each finger portion and the finger portions' end portions. The radial movement of the cartridge case engagement portion is amplified at the end portions that effectuates the release of the bottommost bullet from the stack as well as the collet retraction and the capture of the stack above the bottommost bullet.

In another aspect, the present disclosure is directed at a bullet placing device having a die body further comprising a guide bushing. The guide bushing aids in the alignment of the bullet with collet and the mouth of the cartridge case to help insure that the bullet is properly oriented within the mouth of the cartridge case. The guide bushing may be simply seated within the bullet receiving end of the die body without attachment, providing a simple and easy disassembly or changeout for handling other sizes of bullets.

A feature and advantage of certain embodiments of the invention is that the principle functioning of the apparatus is provided by a single moving component part, the collet with expandable fingers. Said component part engages and disengages with the cartridge, provides release of a single bullet from a bullet stack, provides radial control and retention of the bullet drop, and provides retention of the bullet stack after the single bullet release as the cartridge case and bullet are removed from the die.

A feature and advantage of certain embodiments of the invention is that the drop of the bullet is limited to a distance that is only a fraction of the axial length of the collets, as well as a fraction of the length of the bullet; such limited fall distance minimizes potential misplacements of the bullets in the cartridge cases.

A feature and advantage of certain embodiments of the invention is that the operative component, the resilient plastic collet may in certain embodiments be inexpensively and readily manufactured by injection molding, traditional machining or other production methods.

A feature and advantage of certain embodiments of the invention is that the operative component may be readily replaced to change sizes of bullets and cases to be reloaded.

A feature and advantage of certain embodiments of the invention is that the collet has a plurality of finger portions extending primarily axially that are loaded by the stack of bullets on their axial ends. Such compressive loading provides no meaningful stress and wear on the collet finger portions and moreover does not significantly impede the radial flexibility and resiliency of the finger portions as they are engaged by the cartridge case and outwardly deflect, and as they retract as the cartridge case is withdrawn with a placed bullet. Moreover, the primarily compressive load of the stack of bullets is distributed amongst the plurality of fingers. In certain embodiments four or more fingers, in certain embodiments eight or more fingers. Use of multiple finger portions minimizes the chances of failure and minimizes stress on moving component portions.

A feature and advantage of certain embodiments of the invention is that the functions all occur with minimal deflection of the fingers. The minimal deflection is consistent with long life of the component. In certain embodiments the deflection finger portions can be 0.020 to 0.100 inches, for one example. In another example, 0.030 to 0.050 inches. In particular embodiments, the amplification of the radial movement of the end portions of the finger portions compared to the radial movement of the cartridge case engagement portions may be at least 1.3 to 1, in other embodiments at least 2.0 to one.

A feature and advantage of certain embodiments of the invention is that the weight of the stack of bullets may be utilized to aid in the placement of the bottommost bullet in the case. That is, as the finger end portions are extended radially outward, releasing the bottommost bullet, the entire stack may be released and drops, as a group, the distance to the cartridge case. Moreover, in certain embodiments, the weight of the stack of bullets may counter any tendency of the inside surfaces of the end portions of the finger portions from gripping the outer surfaces of the bottommost bullet as it and the cartridge case are being withdrawn from the collet and die body.

A feature and advantage of certain embodiments is that the ogive tapering profile of typical bullets is utilized to accomplish the multiple functions with a single moving component. That is, the reducing diameter of the ogive towards the bullet tip allows the retention tips of the movable finger portions to retract radially inward to a retention position above the bottommost bullet as the cartridge case with the bottommost bullet therein are withdrawn from the collet and die body. No separation between the bottommost bullet and the next in line bullet in the stack occurs until the finger portions retract blocking the next in line bullet.

A feature and advantage of certain embodiments is that the collet may be readily removed from the bottom of the die for replacement such as for handling different sizes of ammunition. Similarly tubing sized for the bullets above collet in the housing or die may be readily changed out. Such do not need to be secured other than "sitting" them in the die or housing and can thus be simply lifted out and replaced.

In certain embodiments of the invention, the finger portions extend axially and upwardly from the annular body portion of the collet at a connecting portion, the bullet base engagement portions are positioned, at least partially, radially inward from the connecting portion. This advantageously allows the weight of the stack of bullets to provide a radially inward bias thereby urging the opening defined by the finger end portions in a closed direction, radially inward, rather than an open direction, radially outward.

The above summary of the invention is not intended to describe each illustrated embodiment or every implementation of the present invention. The following figures and the detailed description more particularly exemplify these embodiments.

BRIEF DESCRIPTION OF THE DRAWINGS

The invention may be completely understood in consideration of the following detailed description of various embodiments of the invention in connection with the accompanying drawings, in which:

FIG. 1 is a cross-sectional view of a die body in a press with bullets and a cartridge case prior to placement in accord with an embodiment of the invention.

FIG. 2 is an exploded view of a die in accord with an embodiment of the invention.

FIG. 3 is an elevational view of a collet suitable for the invention herein.

FIG. 4 is a partial cross-sectional view of the collet in FIGS. 1, 2 and 3 illustrating the radial deflection of the finger portions.

FIG. 10 is an elevational view of an alternative collet suitable for the invention herein.

Figure 5:
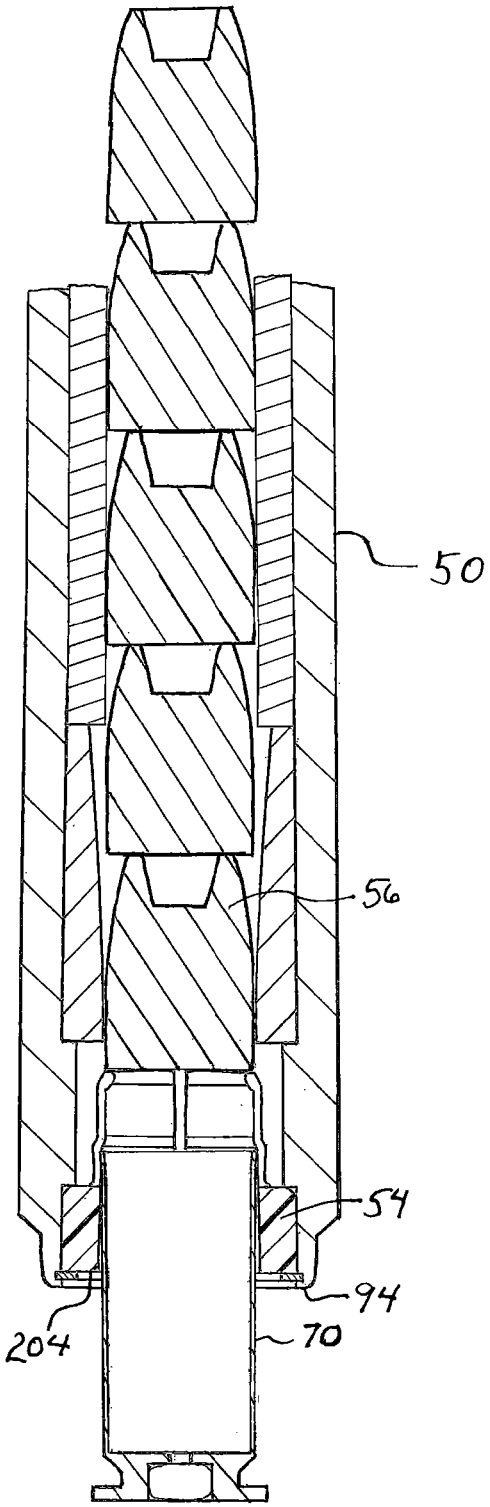
FIG. 5 is a simplified cross-sectional view of the embodiment of FIG. 1 with the cartridge case having entered the cartridge case receiving end of the die body.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE DRAWINGS

Referring to FIGS. 1 and 2, an embodiment of the invention is illustrated and includes a die body 50 with a cartridge case activatable collet 54 for selectively feeding the bottommost bullet 56 from a stack 58 of bullets 59 and configured as part of a loading or reloading apparatus 60. The loading or reloading apparatus may be a conventional reloading press such as available from RCBS of 605 Oro Dam Blvd., Oroville, Calif. 95965. Such presses have a cartridge case holder 64 which may include a cartridge socket 66 for securing a cartridge case 70, and a die body support portion 74 to which the die body may be secured such as by threads 78 in the die body and a nut 82. In such presses the cartridge case holder is may be part of a raisable shelf 84. The shelf can ride on support structure 88, shown schematically by the dashed line, and can be, for example, pillars. A manual lever, not shown can operate to raise and lower the shelf and the cartridge case 70 thereon whereby the case may be inserted and withdrawn from the die body for individually feeding a single bullet by operation of the raising and lowering of the shelf. In some presses, the die body may be moved downwardly to engage the stationary cartridge case on a stationary base or shelf.

The die body 50 generally has an axis 90, a bullet receiving end 92, a cartridge case receiving end 94, and a bore 96 extending axially therein. A bullet feeding tube 104 and a adapter funnel bushing 108 may be utilized for providing a bullet supply above the collet and for adapting a particular die body to different sizes of bullets. Such components may suitably seat on a shoulder 112 in the bore of the die body. The die body 50 may be a ⅞-14 size to be compatible with the majority of reloading presses that are typically employed. However, other size die bodies may be adapted for use with reloading presses of different sizes.

The bullets 59 each have a cylindrical body portion 122 and an ogive portion 124, a bottom 126, and a bottom surface 130. The cartridge case 70 has a body portion 136, a base 138, a rim portion 140, a neck 142, a lip 144, and a mouth 146. The mouth may have a flared portion 148 to facilitate receiving the bullet. The cartridge case will have a primer 157 and the interior 152 filled with gun powder 154 to an suitable level, not shown, prior to the step of placement of the bullet. Engagement of the neck 142 of the cartridge case with the cartridge case socket 66 may be utilized to precisely secure the cartridge case in place for performing loading/reloading steps including the step of placement of the bullet as described herein.

Referring specifically to FIGS. 1, 2, 3, and 4, in a particular embodiment, the expandable collet 54 has an annular body portion configured as a collar portion 162 and a plurality of finger portions 166 with slits or gaps 170 between adjacent finger portions. Each finger portion is integral with and connects to the collar portion at a connection portion 174. Distally positioned from the collar portion, the finger portions 166 each have an end portion 176 and a cartridge case engagement portion 180 with a cartridge case engagement surface 182 positioned intermediate the connection portion and the end portion. The end portions 176 or retention tips each have an uppermost surface defining a bullet support surface 190 and a radially inner most surface 192. The collet has an axis 193 that when in the die body is coextensive with the die body axis 90 and will align with the cartridge case axis 195 when the case is seated and aligned on the press shelf 84. The collet has an inner surface 194 extending the axial length of the collet. In the embodiment illustrated each finger portion has a first proximal segment 196 and a second distal segment 198 joined at the cartridge case engagement portion 180. The end portions are at a bullet receiving end 200 of the collet with the collar portion 162 defining a cartridge case receiving opening 202, a cartridge case receiving end 204, and a bore 206 that may taper from the cartridge case receiving end towards the bullet receiving end. Referring in particular to FIG. 4, the end portions further define a bullet drop opening 212 that has a bullet retaining size with margins 217 defined by the finger portions in an unflexed normal position, a bullet retention position 214 as shown by the sectioned "solid" finger portion and as indicated by the diametric dimension 218. A bullet release position 219 and size with margins 221 defined by the finger portions flexed radially outward is shown in dashed lines and is indicated by the diametric dimension 220. The finger portions flex radially outward as the collet in place in the die body 50 receives a cartridge case that engages the cartridge case engagement surface 182. The diametric dimension may suitably have a difference of 0.020 to 0.100 inches. That is the opening size from the retaining size to the release size is suitable 0.020 to 0.100 inches. Alternatively, the difference is 0.030 to 0.050 inches.

Referring to FIGS. 1 and 2, the collet may be inserted into the die body 50 from the cartridge case receiving end 94 and may suitable be seated on a shoulder 232 in the bore of the die body. The collet may be secured in place by a snap ring 236. Alternatively, the die body may have an internal or external threaded portion at the cartridge case receiving end and a threaded cap or internal nut, not shown, may suitable secure the collet in the die body. Alternatively, the collar portion may have external threads to engage with internal threads in the die body, not shown.

The expandable collet 54 may be formed of a resilient flexible material allowing the expandable collet finger portions 166 to expand and contract. Preferably, the expandable collet 40 comprises a resilient flexible plastic capable of long-term repeated flexing. A wide range of thermoplastics are believed to suitable, for example, ABS (acrylonitrile butadiene styrenes), ketones, polyamides, polyesters, polyetherimides, polypropylene, polystyrenes, and vinyls. The die body, bullet feeding tube 104, and adapter funnel bushing 108 are suitably formed from steel although the bullet feeding tube and adapter plate could suitable be formed of thermoplastics as identified above. Other materials also may be suitable for the collet, such as certain metals. Moreover, in certain embodiments, the collet and feeder components could be configured to be connected.

As depicted in FIGS. 1 and 5-10, a particular embodiment as illustrated operates as follows. With the die body attached to the press and a collet is secured in the die body, the collet configured for the specific bullets and cartridge cases to be assembled. With the cartridge case socket and die body vertically aligned, a stack bullets is fed to the receiving end of the die body and a cartridge case is inserted in the socket as illustrated in FIG. 1. The stack of bullets is supported by the retention tips, the end portions 176 of the finger portions of the collet 54 with the bottommost bullet in direct physical contact with the finger portions 166 of the collet at the end portions.

Figure 6:
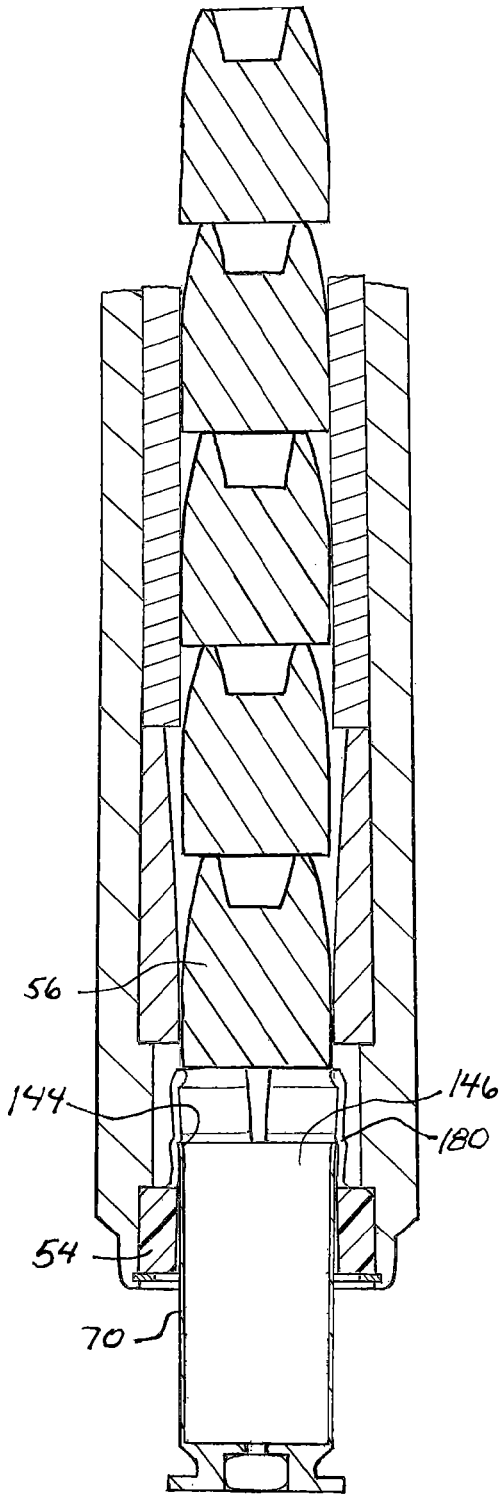
FIG. 6 is the cross-sectional view of the embodiment of FIGS. 1 and 5 with the upper lip of the cartridge case engaging the finger portions initiating a radially outward deflection of the finger portions of the collet.

As illustrated in FIG. 5, the case socket and cartridge case are raised by operation of the press whereby the case cartridge 70 enters the cartridge case receiving end 94 of the die body and the cartridge case receiving end 204 of the collet 54. For simplicity, certain press portions and components illustrated in FIG. 1 are not illustrated in FIGS. 5-9. Referring to FIG. 6, the lip 144 of the cartridge case is further raised to engage the cartridge case engagement portion 180 of the collet 54. During the initial engagement as illustrated in this figure, the finger portions commence to expand radially outward by the force on the case engagement portions. Referring also to FIG. 4, the radial expansion displacement is most pronounced at the end portions and occurs as the fingers rotate outwardly generally about the connection portions 174 with bending occurring in the first proximal segments 196 of the finger portions. The engagement of the cartridge case lip on the inwardly tapered engagement surfaces 182 which are axially positioned inward from the connection portion and the first proximal segments effects a moment on the finger portions at the engagement portions 180. Moreover, the tapered engagement surface 180 operates as a cam follower with the case lip camming the surface 182 urging the engagement portion, and the finger portions radially outwardly.

Figure 7:
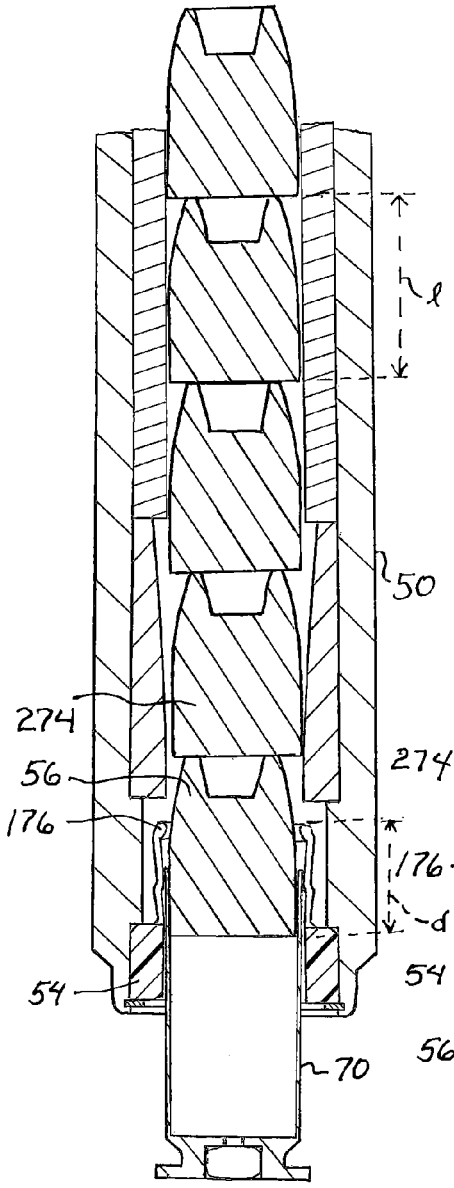
FIG. 7 is a cross-sectional view showing the embodiment of FIGS. 1, 5, and 6 where the upper lip of the cartridge case has effectuated the end portions moving outwardly sufficient to allow the stack of bullets to drop with the bottommost bullet being placed in the mouth of the cartridge case.

Referring in particular to FIG. 7, as the bullet drop opening size exceeds the size of the base of the bullet by the end portions being deflected radially outward caused by the lip engagement with the cartridge case engagement portions, the bottommost bullet 56 of the stack falls through the collet with the bottommost bullet 56 then guided into the mouth 146 of the cartridge case 70. The bottommost bullet falls a bullet drop distance d which is less than the length/of the bullets. At this point, the upward motion of the cartridge case, by way of the press, can stop and reverse to withdraw the cartridge case and placed bullet from the collet and die body. Further, the next in line bullet 274 is positioned above the collet ready for the next cartridge case.

Figure 8:
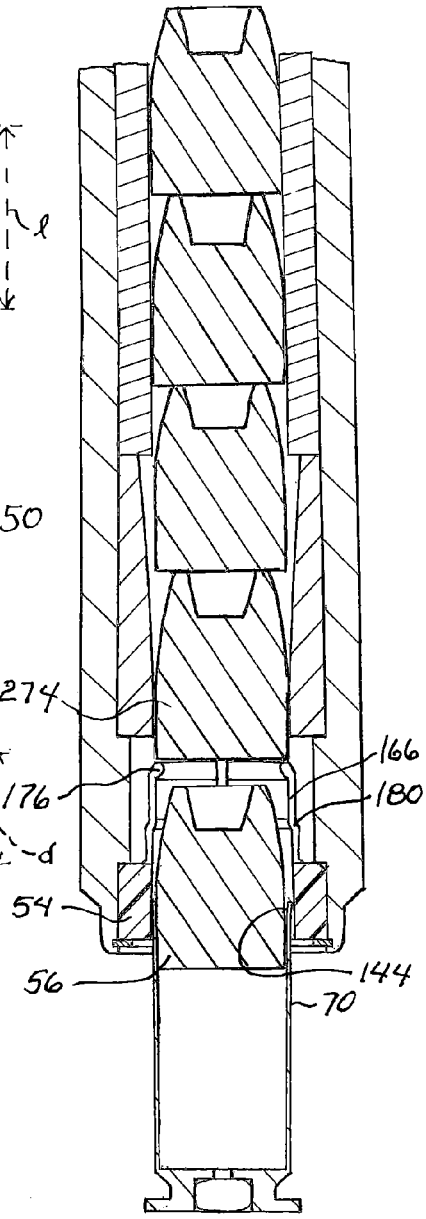
FIG. 8 is a cross-sectional view showing the embodiment of FIGS. 1, 5, 6, and 7 with the cartridge case, with the bottommost bullet therein, being lowered below the cartridge case engagement portion of the finger portions of the collet whereby the end portions have retracted blocking the next in line bullet.
Figure 9:
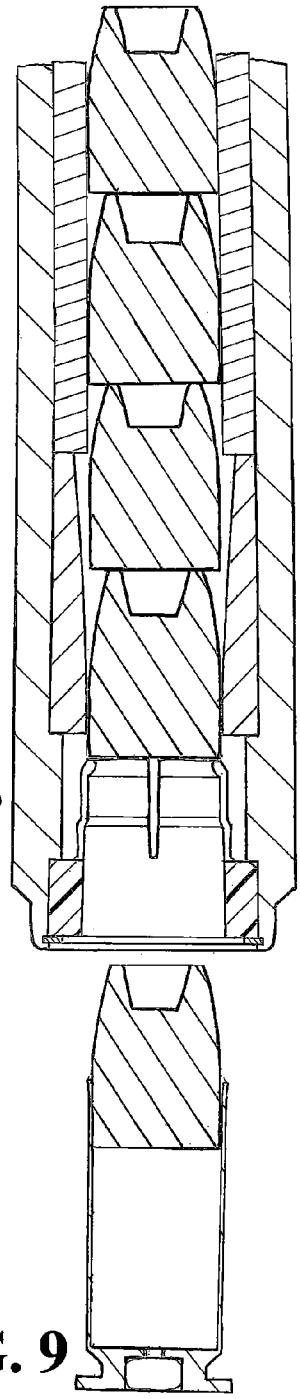
FIG. 9 is a cross-sectional view showing the embodiment of FIGS. 1, 5, 6, 7, and 8 with the bullet received in the cartridge case removed from the die body ready for the next operation in the loading or reloading sequence and the die body ready to receive the next cartridge case.

Referring in particular to FIG. 8, the cartridge case and bullet are being withdrawn and as the cartridge case lip 144 disengages from the cartridge case engagement portion 180 of the collet, the finger portions 166, in particular the end portions 176, retract to the radially inward bullet retaining size so that the opening blocks the next in line bullet 274. FIG. 9 illustrates the cartridge case with the placed bullet removed from the die body ready for the next operation.

Referring to FIG. 10 a different configuration of a collet 300 according to the invention is illustrated. This collet has finger portions 304 with a greater radially inward angulation in their extension from a collar portion 306. The finger portions each have connection portion 308 where they join to the collar portion, first proximal segments 310, second distal segments 312, retention tips 316, and cartridge case engagement portion 320 configured as a shoulder structure and a cartridge case engagement surface 324. The radially inward offset of the engagement portions with respect to the connection portion may provide a more pronounced outward radial deflection of the end portions than the embodiment of FIG. 1. The dashed lines indicate the cartridge case receiving opening 332.

Although specific examples have been illustrated and described herein, it will be appreciated by those of ordinary skill in the art that any arrangement calculated to achieve the same purpose could be substituted for the specific example shown. This application is intended to cover adaptations or variations of the present subject matter. Therefore, it is intended that the invention be defined by the attached claims and their legal equivalents.

What is claimed:

1. A bullet feeding apparatus for sequentially placing bullets into mouths of cartridge cases, the apparatus comprising:

a die body having an axis, a bullet receiving end, a cartridge case receiving end and a bore extending axially therethrough, the bullet receiving end configured for receiving a stack of bullets with each bullet having a base with a diameter, the cartridge case receiving end configured for receiving a cartridge case;

an expandable collet positioned within the bore proximate the cartridge case receiving end, said collet comprising a collar portion with a plurality of flexibly resilient finger portions extending therefrom, the finger portions having bullet support surfaces extending inwardly and facing upwardly for retaining and selectively releasing a bullet, and the fingers portions further having cartridge case engagement surfaces below and spaced from the bullet support surfaces, wherein the finger portions each have a normal unflexed position whereby the bullet support surfaces are in a blocking position with respect to a bottommost bullet in the stack of bullets;

wherein the cartridge case engagement surfaces of each finger portion have cam surfaces configured to engage a lip of the mouth of one of the cartridge cases received in the cartridge case receiving end such that the engagement causes a radially outward deflection of the finger portions that thereby extends the bullet support surfaces radially outward enlarging an opening at the cartridge case engagement surfaces to a diameter slightly larger than the diameter of the bullet base releasing a bullet retained by the bullet support surfaces whereby said bullet may pass through the finger portions and be received by the cartridge case.

2. The bullet feeding apparatus of claim 1 wherein each of the bullets has a bottom surface and each of said plurality of resilient finger portions has an end portion for engagement with the bottom surface of the bullets.

3. The bullet feeding apparatus of claim 1 wherein the collet is formed of metal.

4. The bullet feeding apparatus of claim 3 wherein the cartridge case engagement surface of the finger portions comprises one of a tapered surface and a shoulder structure.

5. The bullet feeding apparatus of claim 1 wherein the collet collar portion is integral with the finger portions.

6. The bullet feeding apparatus of claim 1 wherein each of the plurality of resilient finger portions has an end portion and wherein the cartridge case engagement surfaces are positioned intermediate the collar and the end portions.

7. The feeding placing apparatus of claim 6 wherein the collet is configured for utilization with a bullet of a particular length, and wherein there is an axial distance between the end portions and the cartridge case engagement surfaces and wherein said axial distance is less that the particular length of the bullet for which the collet is configured.

8. The bullet feeding device of claim 1 further comprising a bushing inserted axially within the bullet receiving end of the die body, the bushing configured for receiving a stack of bullets and positioning said stack above the collet.

9. The bullet feeding device of claim 1 further comprising a press with cartridge case holder connected under a die body support portion, the cartridge case holder and die body support portion movable together and away from each other in a vertical alignment, whereby the cartridge case holder receives a cartridge case therein, the cartridge case then movable into and out of the cartridge case receiving end of the die body.

10. The bullet feeding device of claim 9, wherein the collet is a first collet and the apparatus further comprises a plurality of collets of different sizes, and a plurality of bushings of at least two sizes for holding bullets, each of the plurality of collets and plurality of bushings individually insertable in the die body.

11. The bullet feeding device of claim 9 wherein the collet is configured for utilization with a bullet of a particular length, and wherein there is an axial distance between the end portions and the cartridge case engagement surfaces of the collet and wherein when the bullet is released by the end portions, the bullet drops to the case a distance less than the length of said bullet whereby a bullet next in line may be positioned above the end portions of the finger portions.

12. A method of feeding a stack of bullets into a bullet receiving end of a die body to be placed in cartridge cases inserted into an opposite receiving end of the die body, the method comprising the steps of:

retaining the stack of bullets each with a base having an outer diameter in the receiving end of the die body by supporting the bottommost bullet in the stack by bullet supporting portions of a plurality of circularly arranged finger portions, each finger portion resiliently and integrally connected to a collar portion, wherein the finger portions are positioned in a normal unflexed position with the bullet supporting portions within the outer diameter of the base of the bottommost bullet of the stack of bullets;

inserting a cartridge case upwardly into the collar portion to engage interior surfaces of the finger portions with an upper lip of the cartridge case thereby deflecting the finger portions radially outwardly to a flexed position such that the bullet supporting portions are moved outside the outer diameter of the bottommost bullet to allow the bottommost bullet in the stack to drop into the cartridge case.

13. The method of claim 12, further comprising the step of withdrawing the cartridge case downwardly within the collet to disengage the lip of the cartridge case from the interior surfaces of the finger portions whereby the finger portions retract to block a next in line bullet stacked above the bullet.

14. The method of claim 13 further comprising the step of repeating the process through the stack of bullets.

15. The method of claim 14 comprising the steps of providing a plurality of bullets of a different size and changing out the collet from the die body with a different collet compatible with the different size of the plurality of bullets.

* * * * *

UNITED STATES PATENT AND TRADEMARK OFFICE

CERTIFICATE OF CORRECTION

PATENT NO. : 8,707,845 B2
APPLICATION NO. : 13/406200
DATED : April 29, 2014
INVENTOR(S) : Koch et al.

It is certified that error appears in the above-identified patent and that said Letters Patent is hereby corrected as shown below:

In the Claims,

In Column 8, Line 53, Claim 7, delete "feeding placing apparatus" and insert -- bullet feeding apparatus --, therefor.

In Column 8, Line 57, Claim 7, delete "less that" and insert -- less than --, therefor.

In Column 8, Line 59, Claim 8, delete "device" and insert -- apparatus --, therefor.

In Column 8, Line 63, Claim 9, delete "device" and insert -- apparatus --, therefor.

In Column 9, Line 4, Claim 10, delete "device" and insert -- apparatus --, therefor.

In Column 9, Line 10, Claim 11, delete "device" and insert -- apparatus --, therefor.

Signed and Sealed this
Twentieth Day of January, 2015

Michelle K. Lee

Michelle K. Lee
*Deputy Director of the United States Patent and Trademark Office*